United States Patent [19]

Smith, Jr. et al.

[11] 4,445,943

[45] May 1, 1984

[54] HEAT TREATMENTS OF LOW EXPANSION ALLOYS

[75] Inventors: Darrell F. Smith, Jr.; Edward F. Clatworthy, both of Huntington, W. Va.

[73] Assignee: Huntington Alloys, Inc., Huntington, W. Va.

[21] Appl. No.: 302,974

[22] Filed: Sep. 17, 1981

[51] Int. Cl.[3] ..... C21D 7/14; C22F 1/10

[52] U.S. Cl. ..... 148/12.3; 148/12.7 R; 148/12.7 N; 148/31; 148/142; 148/158; 148/162; 148/409; 148/410; 148/419

[58] Field of Search ..... 148/158, 162, 142, 32.5, 148/31, 12.3, 12.7 R, 12.7 N

[56] References Cited

U.S. PATENT DOCUMENTS 4,200,459 4/1980 Smith, Jr. et al. ..... 148/32.5

*Primary Examiner*—R. Dean

*Attorney, Agent, or Firm*—Miriam W. Leff; Ewan C. MacQueen; Raymond J. Kenny

[57] ABSTRACT

Directed to an overaging heat treatment applied to age-hardenable nickel-iron controlled expansion alloys so as to contribute high notch strength at temperatures on the order of about 1000° F. thereto.

15 Claims, No Drawings

HEAT TREATMENTS OF LOW EXPANSION ALLOYS

The invention is directed to a heat treatment method for application to age-hardenable controlled expansion alloys which provide adequate tensile strength together with required notch strength at temperatures on the order of 1000° F.

BACKGROUND OF THE INVENTION AND THE PRIOR ART

Controlled expansion alloys are useful in many applications, most of which, to date have not represented major markets for metal. For example, the Eiselstein and Bell, U.S. Pat. No. 3,157,495 is directed to a nickel-coablt-iron alloy having controlled thermo-elastic properties up to elevated temperatures. The alloys provided in accordance with this patent are age-hardenable and develop excellent strength and ductility values at ordinary temperatures. In addition, the alloys were found to have highly useful strength properties at elevated temperatures and had long rupture lives at temperatures up to 1000° F. although quite low ductility in properties were then observed.

U.S. Pat. No. 3,705,827 reports on a heat treatment procedure for heat treating age-hardenable chromium-free and chromium-containing nickel-iron alloys. Development of high strength in the age-hardenable alloys together with useful rupture life at temperatures on the order of 1150° F. are reported in this patent.

U.S. Pat. No. 4,006,011 is directed to an essentially chromium-free, age hardenable, nickel-cobalt-iron alloy capable of providing high strength at ordinary temperatures and having useful stress rupture properties at certain elevated temperatures, such as 1150° F.

Recently, an interest has been expressed in alloys having controlled expansion characteristics up to temperatures in the order of 1000° F. or 1100° F. Thus, it has been considered that various parts used in aircraft gas turbine engines, such as rings, seals, casings, nozzle supports, etc. could usefully be produced of nickel-iron or nickel-cobalt-iron alloys having controlled expansion characteristics even though the alloys are ordinarily regarded as being deficient in oxidation resistance in oxidizing atmospheres at temperatures encountered in the hot zones of aircraft gas engines. Further pursuit of the requirements properly to be imposed upon such alloys in aircraft gas engine applications has developed the fact that the alloys and the heat treatments therefore which have been provided to date are still subject to deficiencies, namely inadequate notch strength at temperatures on the order of 1000° F. Thus, even the alloys provided in accordance with the teachings of U.S. Pat. No. 4,200,459 which are nickel-iron-cobalt alloys having controlled low aluminum contents were still deficient in notch strength at temperatures of 1000° F. or thereabouts when subjected to the age-hardening treatment schedules disclosed.

Progress in the development of the alloys have now lead to heat treatments applicable to alloys akin to those disclosed in U.S. Pat. No. 4,200,459 which are capable of rendering the alloys in a condition wherein they have adequately high tensile strength and ductility together with adequately high notch strength at the temperatures of interest to aircraft engine designers, e.g. 1000° F. Along with the developing need for high notch strength at elevated temperatures, purchasers of controlled expansion alloys have become increasingly concerned about the availability and cost of the cobalt used in these alloys. A demand has accordingly been created not only for alloy articles and parts having mechanical properties newly recognized as being necessary but also for alloys which would be essentially cobalt-free while still retaining useful expansion characteristics. It is the purpose of the present invention to supply the foregoing complex of requirements in a practical way.

SUMMARY OF THE INVENTION

The invention is based on the discovery that certain heat treating sequences involving a solution treatment, an intermediate temperature treatment and an aging treatment can provide overaged structures in age-hardenable nickel-iron controlled expansion alloys whereby combinations of properties including short time strength and ductility and elevated temperature notch strength can be provided therein.

DETAILED DESCRIPTION OF THE INVENTION

The invention is directed to heat treatments applicable to nickel-iron alloys containing about 45% to about 55.3% nickel, up to about 5% cobalt, about 1% to about 2% titanium, about 1.5% to about 5.5% columbium, not more than about 0.2% aluminum and the balance is essentially iron. Tantalum may be substituted for columbium on the basis of two parts tantalum for each part of columbium, by weight.

Incidental elements, e.g., deoxidizers, malleabilizers, scavengers and tolerable impurities may be present in amounts inclusive of up to about 0.01% calcium, up to 0.01% magnesium, up to 0.03% boron, up to 0.1% zirconium, up to 0.5% silicon and up to about 1% each of copper, molybdenum and tungsten. Sulfur and phosphorus are undesirable and usually restricted to no more than about 0.015% individually.

The alloys of the invention are provided in wrought form, such as strip, sheet, rings and the like. The heat treatments in accordance with the invention comprise a solution treatment which is usual in heat treating age-hardenable nickel-base alloys, an intermediate temperature isothermal treatment, followed by a lower aging temperature exposure. This can be accomplished by e.g., air cooling after the intermediate temperature exposure then employing a two step aging treatment or by controlled cooling, e.g., directly furnace cooling to the lower aging temperature. Controlled cooling as used herein refers to cooling at a rate of about 20° F. to 200° F. per hour. Solution heat treatments will range between about 1600° F. and 1925° F. The intermediate temperature treatment will be in the range of about 1400° F. to about 1575° F., typically about 1425° F. to 1550° F. for various times between about 8 and about 32 hours and the aging heat treatment will be normally at a temperature of about 1300° F.–1400° for 8 hours followed by furnace cooling to about 1100° –1200° F. for about 8 hours in the case of the three step treatment. Alternatively, the alloy may be cooled at a controlled rate, e.g., 20° F. to 200° F./hr directly from the intermediate temperature to a temperature at least about 100° F. therebelow, e.g., about 1100° F. to 1200° F. for the two step age.

As is common in the treatment of age-hardenable nickel-base alloys, solution treatment is not conducted for a longer period of time than is necessary to dissolve the age-hardening components in the metal matrix.

Usually about 1 hour of through heating of the part being heat treated is sufficient as a solution treating time.

The time employed for the intermediate treatment can vary considerably, with the treatment being upwardly graduated in both temperature and time as the annealing temperature is increased. Of course, for economic operation it is desirable that the total heat treatment time be as short as possible. It is to be appreciated that the recrystallization temperature for alloys to be heat treated in accordance with the invention is approximately 1650° F. to 1700° F. with the actual temperature at which recrystallization occurs being dependent upon composition and thermal mechanical processing history.

It should be appreciated that the best strength properties are obtained when the solution treating temperature is about 1625° F. This is a temperature safely below the recrystallization temperature for alloys defined herein. However, in respect of parts which must be brazed, higher solution treating temperatures are required. When such is the case, the solution treating temperature will be above the recrystallization temperature for the alloy. It is, of course, recognized that excess grain growth as a result of exposure at the solution treating temperature is undesirable. The heat treatments accomplished in accordance with the invention are essentially overaging treatments and it is to be appreciated that the heat treatments described herein provide tradeoffs in properties. Thus, in order to obtain the designer required notch strength, it is necessary to heat treat the alloy by overaging such that the optimum short term strength and ductility values may not be and usually will not be obtained. The treatments in accordance with the invention give overaged structures with improved resistance to oxidation related rupture failures.

Contrarywise, it is found that, in the alloys treated in accordance with the invention, heat treatments which provide the highest short time strength and ductility generally provide inadequate notch strength at elevated temperatures especially in the critical temperature region around 1000° F.

The age-hardenable controlled expansion alloys heat treated in accordance with the invention will generally obtain a notched bar rupture life of at least about 20 hours at 1000° F. and a stress of 100 ksi with a life of 100 hrs. or more being attained in many instances. Longer heat treating times are usually required to attain the higher notch strengths.

In the following Table I, three heat treatment sequences are shown as examples in accordance with the invention.

TABLE I

| Condition | Annealed | Aged |
|---|---|---|
| B | 1625° F./1 h air cooled | 1500° F./8 h, air cool, 1325° F./8 h, furnace cool to 1150° F./8 h, air cool |
| C | 1750° F./1 h air cooled | 1525° F./32 h, air cool 1325° F./8 h, furnace cool to 1150° F./8 h, air cool |
| D | 1900° F./1 h air cooled | 1525° F./32 h, air cool 1325° F./8 h, furnace cool to 1150° F./8 h, air cool |

Of the foregoing treatments, Condition D is applied in applications in which brazing is required. Condition B provides optimum transverse rupture strength. Condition C provides a fine grain recrystallized structure with good stress rupture strength.

It has been found that the heat treated alloy is extremely sensitive to the testing direction. Thus, testing in the longitudinal direction is usually most beneficial for the purpose of reporting high properties. However, if the test orientation is in a transverse direction, greatly inferior properties can be obtained in the same material. One application envisioned for the alloy is a large ring which is produced by rolling. In such rings, the long transverse direction is the direction in the surface of the ring taken perpendicular to the circumference whereas the short transverse direction is taken in the thickness of the ring moving along a radius. Testing in the short transverse direction is particularly sensitive.

Some examples will now be given.

EXAMPLE 1

A laboratory vacuum induction melt of the alloy of the invention was prepared the composition of which is given in Table II as Alloy No. 1.

The heat was converted into products including 9/16"×4" flat bar. Smooth bar room temperature tensile tests were conducted as well as separate smooth bar and notched bar rupture tests at 1000° F. The results are shown in Table III. The notch bar specimen had a 0.250" diameter notch, a 0.0363" root radius and a shoulder diameter of about 0.350". The bar was of double shanked configuration. The geometry described gives a $K_t=2$.

EXAMPLE 2

A commercial size heat (Alloy 2) of the alloy of the invention was prepared, the composition of which is given in Table II.

The commercial scale heat was prepared using the vacuum induction plus vacuum arc remelt process.

Hot rolled products including flats, ¾" thick by 6" wide were prepared.

Hot rolled flat from Alloy No. 2 was used as material for a series of tests, including room temperature tensile, in the long transverse direction. The stress rupture testing was conducted at 1000° F. and at the loads indicated in the tables in the long transverse direction.

A combination smooth and notch bar was used in the testing with the 1625° solution treatment and was stressed at 120 Ksi. The smooth test section was 0.178" dia. by 0.715" gage length with a notch section of 0.178" dia. with root radius of 0.006" and having a stress concentration factor ($K_t$) of 3.6.

The results of the testing together with the heat treatments employed are shown in the following Tables IV (tensile) and V (rupture). From the Tables it is to be seen that the heat treatment which produced the highest room temperature strength and ductility provided inferior properties when tested at 1000° F. and 120 ksi in the stress rupture test with failure occurring in the notch.

It was only when the intermediate aging temperature was increased to 1475° F. for 8 h as shown in Table V that adequate life in these stress rupture tests was provided with failure in the smooth bar portion of the test specimen. The room temperature properties in this heat were lower than found for intermediate temperature heat treatments at lower temperatures but are still high and adequate for the intended use.

Further tests were conducted to determine the effects of a higher annealing temperature (1750° F.) on tensile properties and rupture properties with a $K_t=3.6$ combination test bar as described. The results are provided in Table VI.

Heat treatments employing a solution treatment of 1900° F. with various aging treatments were investigated with the results shown in Tables VII (tensile), and VIII (stress-rupture). The results show that the target of 20 hours for notch strength at 1000° F. and 100,000 psi was achieved.

TABLE II

| | Chemical Analyses (Wt. %) | |
|---|---|---|
| | Alloy 1 | Alloy 2 |
| C | <.01 | .03 |
| Mn | .09 | .04 |
| Fe | BAL | BAL |
| S | .002 | .003 |
| Si | .11 | .10 |
| Ni | 49.48 | 49.04 |
| Cr | .04 | .02 |
| Al | .02 | .04 |
| Ti | 1.44 | 1.48 |
| Cb | 4.35 | 4.70 |
| Co | .02 | .60 |
| B | .005 | .008 |

TABLE V

Effect of Aging Treatments
On 1000° F./120 ksi(1) Rupture
Product: Hot Rolled Flat (.750" × 6" × L)
Condition: As Rolled
Alloy #2
Test Orientation: Long Transverse
Anneal: 1625° F./1 hr, Air Cool

| Heat Treatment (°F./hr) | Final Stress (ksi) | Type of Test | Life (Hrs) | El (%) | RA (%) |
|---|---|---|---|---|---|
| Two-Step Age* | | | | | |
| 1250/8 FC* | 120 | C-B | 1.5 | NOTCH | |
| " | 120 | S-B | 35.2 | BIT | |
| 1325/8 FC* | 120 | C-B | 3.7 | NOTCH | |
| " | 120 | S-B | 34.0 | .3 | 0 |
| 1400/8 FC* | 120 | C-B | 50.9 | NOTCH | |
| " | 130 | S-B | 538.6 | 3.5 | 7.5(2) |
| 1475/8 FC* | 120 | C-B | 109.6 | 9. | 21.(1) |
| " | 130 | S-B | 559.1 | 7. | 12.(2) |
| Three-Step Age** | | | | | |
| 1450/4 | 120 | C-B | 62. | NOTCH | |
| " | 130 | S-B | 516.2 | 8.5 | 15.5(2) |
| 1450/8 | 130 | C-B | 598.7 | NOTCH | (2) |
| " | 130 | S-B | 499. | 10. | 21.(2) |
| 1500/4 | 130 | C-B | 510.8 | 3. | 3.5(2) |
| " | 130 | S-B | 547.6 | 5. | 11.(2) |
| 1500/8 | 120 | C-B | 250.6 | 7. | 22. |
| " | 120 | S-B | 118. | 6. | 16. |
| 1550/4 | 120 | C-B | 162.6 | NOTCH | |
| " | 140 | S-B | 794.4 | 2.5 | 6.(3) |
| 1550/8 | 120 | C-B | 279.8 | NOTCH | |
| " | 140 | S-B | 527.2 | 6. | 6.(4) |

*Furnace cooled 100°/hr to 1150°/8 hr, AC
**Int Age Temp-Time Shown, AC + 1325/8 hr, FC* Age
BIT — Broke in Thread
(1)Pulled Out of Grips at 109 Hrs, Reloaded
(2)Stress Inc to 130 ksi at Approx 500 Hrs
(3)Stress Inc to 130 ksi at Approx 500 Hrs, Inc to 140 ksi @ 791 Hrs
(4)Stress Inc to 130 ksi at Approx 162 Hrs, Inc to 140 ksi @ 500 Hrs
C-B = Combination Bar
S-B = Smooth Bar

TABLE III

Alloy #1
Product: Hot Rolled 9/16" × 4" Flat
Effect of Anneal on Mechanical Properties (Long-Trans)

| | | RIT | | | | 1000° F. Rupture | | | | $K_t = 2$ |
|---|---|---|---|---|---|---|---|---|---|---|
| | | 0.2% | | | | | Smooth | | | Notch |
| Ann °F./Hr + Age | GS (ASTM) | YS ksi | TS ksi | El % | RA % | Stress ksi | Life Hrs. | El % | RA % | Life Hrs. |
| 1600/1, A + 1425 D.A. | #1-E | 137. | 165.5 | 18.5 | 40. | 120. | 447. | 4. | 3. | 597.4 |
| 1700/1, A + 1425 D.A. | #½-E | 134.5 | 165.5 | 20.5 | 44.5 | 120. | 558.2 | 6.5 | 6.5 | 870. |
| 1800/1, A + 1425 D.A. | #6M | 159. | 187.5 | 15. | 100. | 16.3 | 2.5 | 5.5 | 9. | |
| 1900/1, A + 1425 D.A. | #3 | 144. | 171. | 14.5 | 27. | 100. | 8.7 | 3. | 8.5 | 1.8 |

16 E–Elongated
M–Mixed
D.A.–Aged at 1425° F./8 hr FC (100°/Hr) to 1150° F./8 Hr, AC

TABLE IV

Effect of Aging Treatments
On RT Tensile Properties
Product: Hot Rolled Flat (.750" × 6" × L)
Condition: As Rolled
Alloy #2
Test Orientation: Long Transverse
Anneal: 1625° F./1 hr, Air Cool

| Heat Treatment (°F./Hr) | 0.2% Y.S. (ksi) | Ten Str (ksi) | El (%) | RA (%) |
|---|---|---|---|---|
| As Annealed, AC | 73.2 | 116. | 37.5 | 49.5 |
| Two-Step Age* | | | | |
| 1250/8 FC* | 188.5 | 210.5 | 12.5 | 31. |
| 1325/8 FC* | 177. | 201. | 11.5 | 18.5 |
| 1325/8 FC* | 174.5 | 198.5 | 15. | 32.5 |
| 1400/8 FC* | 151.5 | 179.5 | 15.5 | 34. |
| 1475/8 FC* | 138.5 | 172. | 16. | 27.5 |
| Three-Step Age** | | | | |
| 1450/4 | 154.5 | 183.5 | 14. | 29. |
| 1450/8 | 130. | 167. | 16. | 29. |
| 1500/4 | 152. | 181.5 | 14. | 26.5 |
| 1500/8 | 146.5 | 178.5 | 14. | 25. |
| 1550/4 | 169. | 195.5 | 12.5 | 23. |
| 1550/8 | 163. | 190.5 | 13. | 22. |

*Furnace cooled 100°/hr to 1150° F./8 hr, AC
**Int Age Temp-Time Shown, AC + 1325° F./8 hr, FC* Age

TABLE VI

Effect of Aging Treatments
on Tensile and 1000° F. Rupture
Product: Hot Rolled Flat (.750" × 6" × L)
Condition: As Rolled
Alloy #2
Test Orientation: Long Transverse
Anneal: 1750° F./1 Hr, Air Cool

| Heat Treatment (°F./Hr) | 0.2% YS (ksi) | TS (ksi) | El % | RA % | Rupture Stress (ksi) | Combination Bar Life (Hrs) | El % | RA % |
|---|---|---|---|---|---|---|---|---|
| Two-Step Age* | | | | | | | | |
| 1325/8 FC* | 175.5 | 199.5 | 15. | 36.5 | 110 | 10.0 | NOTCH | |
| Three-Step Age** | | | | | | | | |
| 1550/8 | 168. | 196. | 11.5 | 17. | 120 | 5.0 | NOTCH | |
| 1550/16 | 143. | 185.5 | 11.5 | 13. | 120 | 7.7 | NOTCH | |
| 1550/24 | 128.5 | 181.5 | 11.5 | 15. | 120 | 35.0 | NOTCH | |

*Furnace Cooled 100° F./Hr to 1150° F./8 Hr AC
**Int Age Temp-Time Shown, AC + 1325/8 FC* Age

TABLE VII

Effect of Intermediate Aging on
Room Temperature Tensile Properties
Product: Hot Rolled Flat (0.750" × 6" × L)
Alloy #2
Test Orientation: Long Transverse
Heat Treatment: Anneal - 1900° F./1 Hr, AC + Intermediate
Age Shown, AC + Final Age - 1325° F./8 Hr,
FC 100°/Hr to 1150° F./8 Hr, AC
Annealed Grain Size: ASTM #3.5

| Intermediate Age (°F./Hr) | Hard Rc | 0.2% YS ksi | Ten Str ksi | El % | RA % |
|---|---|---|---|---|---|
| None | 42. | 171.5 | 196.5 | 16. | 40. |
| 1400/4 | 40. | 165.5 | 193.0 | 14.5 | 32.5 |
| 1400/8 | 39. | 157.5 | 189.0 | 12.5 | 28. |
| 1400/16 | 40.5 | 158.5 | 190.5 | 11.5 | 20.5 |
| 1400/24 | 38. | 133.0 | 177.0 | 13.5 | 25. |
| 1450/1 | 41.5 | 172.0 | 196.5 | 15. | 37.5 |
| 1450/4 | 40.5 | 170.5 | 195.5 | 14. | 30.5 |
| 1450/8 | 32.5 | 124.5 | 167.5 | 18.5 | 37.5 |
| 1450/24 | 31.5 | 107.0 | 156.0 | 20. | 30. |
| 1500/4 | 41. | 171.5 | 196.5 | 13. | 32.5 |
| 1500/8 | 42.5 | 164.5 | 196.5 | 12.5 | 25. |
| 1500/24 | 35. | 116.0 | 174.5 | 14. | 16. |
| 1525/24 | 40. | 146.5 | 173.5 | 9.5 | 20. |
| 1525/32 | 36.5 | 117.5 | 163. | 8. | 18. |
| 1550/4 | 41. | 170.0 | 196.0 | 13. | 26.5 |
| 1550/8 | 41.5 | 178.5 | 198.0 | 13. | 26. |
| 1550/16 | 40.5 | 163.0 | 192.5 | 10.5 | 16. |
| 1550/20 | 42. | 160.0 | 193.5 | 10. | 15. |
| 1550/24 | 41. | 145.5 | 188.0 | 10.5 | 13.5 |
| 1550/24 | 41. | 149.5 | 184.5 | 6.5 | 17.5 |
| 1550/32 | 40.5 | 144.0 | 186.0 | 8. | 18. |
| 1550/54 | 37.5 | 114.5 | 163.5 | 9.5 | 16. |
| 1575/24 | 38. | 148.0 | 179. | 9.5 | 21. |
| 1575/32 | 37. | 129.5 | | 9.5 | 17. |

TABLE VIII

Effect of Intermediate Aging on
1000° F. Stress-Rupture Properties
Product: Hot Rolled Flat (0.750" × 6" × L)
Alloy #2
Test Orientation: Long Transverse
Heat Treatment: Anneal - 1900° F./1 Hr, AC + Intermediate
Age Shown, AC + Final Age - 1325° F./8 Hr
FC 100°/Hr to 1150° F./8 Hr, AC
Annealed Grain Size: ASTM #3.5

| Intermediate °F./Hr | Stress ksi | Smooth Bar Life Hr | El % | RA % | $K_t = 2$ Notch Bar Life Hr |
|---|---|---|---|---|---|
| None | 100 | 17.5 | 0.5 | 0. | 1.6 |
| 1400/4 | 100 | 8.3 | 5. | 6.5 | 9.7 |
| 1400/8 | 100 | 18.2 | 4.5 | 6.5 | 10.9 |
| 1400/16 | 100 | 66.5 | 2. | 2.5 | |
| 1400/24 | 100 | 89.8 | 0.5 | 0. | 20.7 |

TABLE VIII-continued

Effect of Intermediate Aging on
1000° F. Stress-Rupture Properties
Product: Hot Rolled Flat (0.750" × 6" × L)
Alloy #2
Test Orientation: Long Transverse
Heat Treatment: Anneal - 1900° F./1 Hr, AC + Intermediate
Age Shown, AC + Final Age - 1325° F./8 Hr
FC 100°/Hr to 1150° F./8 Hr, AC
Annealed Grain Size: ASTM #3.5

| Intermediate °F./Hr | Stress ksi | Smooth Bar Life Hr | El % | RA % | $K_t = 2$ Notch Bar Life Hr |
|---|---|---|---|---|---|
| 1450/4 | 100 | 20.0 | 2. | 0.5 | 6.6 |
| 1450/8 | 100 | 47.4 | 0.5 | 0. | 7.6 |
| 1450/24 | 100 | 590.8 | 2.5 | 0. | 321.0 |
| 1500/4 | 100 | 20.7 | 0.5 | 6. | 3.3 |
| 1500/8 | 100 | 16.6 | 0.5 | 0. | 6.9 |
| 1500/24 | 100 | 524.1 | 1.5 | 4. | 29.0 |
| 1525/24 | 120 | 64.6 | 2.0 | 0. | 17.1 |
| 1525/32 | 120 | 308.7 | 1.6 | 3. | 88.6 |
| 1550/4 | 100 | 9.8 | 0.5 | 0. | 3.8 |
| 1550/8 | 100 | 33.8 | 4.5 | 2. | 9.8 |
| 1550/16 | 100 | 60.8 | 2. | 0. | |
| 1550/20 | 100 | 598.4 | 0.5 | 1. | |
| 1550/24 | 100 | 2400.1 | BIT | | D2040. |
| 1550/24 | 120 | 54.2 | 3.0 | 10.5 | 16.6 |
| 1550/32 | 120 | 34.9 | 3.5 | 6.5 | 30.7 |
| 1550/54 | 120 | 68.4 | 5.5 | 2. | 158.7 |
| 1575/24 | 120 | 29.7 | BIT | | 10.4 |
| 1575/32 | 120 | 7.7 | BIT | | 26.3 |

BIT — Broke in Threads
D — Discontinued

Alloys in accordance with the invention are produceable by usual production means such as vacuum induction melting, vacuum arc remelting and other combinations. Ingots up to 30-inches in diameter have been produced in Alloy No. 2. The alloy is readily weldable by methods such as electron beam welding, TIG, etc. It seems to be important in terms of avoidance of segregation in the ingot, weldability, hot workability, etc. to limit the total hardener content as expressed by the relationship Ti+columbium divided by 2 not to exceed 4.5, and preferably not to exceed 4.

Since the alloys of the invention are essentially free of chromium, many differences exist in comparison to chromium-containing alloys of the same hardener content. The compositions of the equilibrium phases are believed to be different and the failure mechanism under stress is distinctly different.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The method for providing elevated temperature notch strength in wrought products made of an alloy consisting essentially of about 45% to about 55.3% nickel, up to about 5% cobalt, about 1.5% to about 5.5% columbium, about 1% to about 2% titanium, no more than 0.2% aluminum, up to about 0.1% carbon and the balance essentially iron, which comprises annealing said product at a temperature of about 1600° F. to about 1925° F. and then heating said solution treated product in the intermediate temperature range of about 1425° F. to about 1550° F. for a time sufficient to overage said product in the range of about 8 to 32 hours, with the proviso that said intermediate temperature and time are upwardly graduated as the annealing temperature is increased, and then heat treating said product in a lower temperature range of about 1100° F. to 1400° F. for at least about 8 hours to provide in said product a notch strength of at least about 20 hours at 1000° F. and 100 ksi.

2. The method in accordance with claim 1 wherein the product is slowly cooled from the intermediate temperature to a temperature within the lower temperature range.

3. The method in accordance with claim 2 wherein the cooling rate is about 20° F. per hour to 200° F. per hour.

4. The method in accordance with claim 1 wherein the annealed product is heated isothermally in the intermediate temperature range, is slowly cooled to a temperature in the lower temperature range and is then isothermally treated.

5. The method in accordance with claim 1 wherein the product is air cooled from the intermediate temperature and is thereafter subjected to two-step aging treatment in the lower aging temperature range wherein the temperature of the first step is at least about 100° F. higher than the temperature of the second step.

6. The method in accordance with claim 1, wherein the alloy contains up to about 0.03% boron.

7. The method in accordance with claim 1, wherein any part of the columbium content of the alloy may be substituted with tantalum on the basis of two parts of tantalum for each part of columbium, by weight.

8. A controlled expansion age hardened alloy consisting essentially of about 45% up to about 55.3% nickel, about 1.5% to about 5.5% columbium, about 1% to about 2% titanium, not over 0.2% aluminum, not over 0.1% carbon, up to about 5% cobalt, and the balance essentially iron, with the proviso that any part of the columbium content may be substituted for by tantalum on the basis of two parts of tantalum for each part of columbium, by weight, said alloy being in the heat treated condition which includes an overaging treatment and being characterized by a notch strength of at least about 20 hours at 1000° F. and 100 ksi.

9. A controlled expansion age hardened alloy in accordance with claim 8 containing up to about 0.03% boron.

10. A controlled expansion age hardened alloy in accordance with claim 8 containing up to 0.01% calcium, up to 0.01% magnesium, up to 0.1% zirconium, up to 0.5% silicon and up to 1% each of copper, molybdenum and tungsten.

11. A controlled expansion age hardened alloy in accordance with claim 8, wherein the titanium+columbium level in the alloy does not exceed 4.5.

12. A wrought product made of a controlled age hardened alloy of claim 8.

13. The method for providing elevated temperature notch strength in wrought products made of an alloy consisting essentially of about 45% to about 55.3% nickel, up to about 5% cobalt, about 1.5% to about 5.5% columbium, about 1% to about 2% titanium, no more than 0.2% aluminum, up to about 0.1% carbon and the balance essentially iron, the columbium being replaceable by tantalum on the basis of two parts of tantalum for each part of columbium, by weight, which comprises annealing said product at a temperature of about 1600° F. to about 1925° F. and then heating said solution treated product in the intermediate temperature range of about 1400° F. to about 1575° F. for a time sufficient to overage said product in the range of about 4 to 54 hours, with the proviso that said intermediate temperature and time are upwardly graduated as the annealing temperature is increased, and then heat treating said product in a lower temperature range of about 1100° F. to 1400° F. for at least about 8 hours to provide in said product a notch strength of at least about 20 hours at 1000° F. and 100 ksi.

14. A controlled expansion age hardened alloy made by the process of claim 7.

15. A controlled expansion aged hardened alloy made by the process of claim 13.

* * * * *